US005460208A

United States Patent [19]

deBerardinis

[11] Patent Number: 5,460,208

[45] Date of Patent: Oct. 24, 1995

[54] TRANSPORTABLE LIQUID PRODUCTS CONTAINER

[76] Inventor: Nicholas W. deBerardinis, 15003 Marlebone Ct., Houston, Tex. 77069

[21] Appl. No.: 229,577

[22] Filed: Apr. 19, 1994

Related U.S. Application Data

[63] Continuation of Ser. No. 829,027, May 28, 1991, Pat. No. 5,365,980.

[51] Int. Cl.[6] ..... B63B 27/00

[52] U.S. Cl. ..... 141/1; 141/2; 114/72; 114/74 R

[58] Field of Search ..... 141/1, 2, 231; 114/72, 73, 74 R; 414/139.4

[56] References Cited

U.S. PATENT DOCUMENTS 4,072,120 2/1978 Bylo ..... 114/72
4,666,356 5/1987 Newbury ..... 414/143.2 X
4,960,347 10/1990 Strange ..... 114/74 R X
4,988,020 1/1991 Webb ..... 141/88 X

FOREIGN PATENT DOCUMENTS 2049570 12/1980 United Kingdom ..... 141/231

*Primary Examiner*—J. Casimer Jacyna
*Attorney, Agent, or Firm*—William J. Beard

[57] ABSTRACT

Methods for transporting and unloading liquid cargo by water borne vessels are disclosed. At least two unstackable containers are transported to a remote unloading location by water borne vessel. One of the containers, substantially empty, is unloaded from the vessel onto a dockage area. Liquid cargo from the second unstackable container can be offloaded onto the dockage area and the proceeds repeated from third, fourth, and so on, unstackable containers until all liquid cargo desired to be offloaded resides in the dockage area in the unloaded containers.

9 Claims, 4 Drawing Sheets

TRANSPORTABLE LIQUID PRODUCTS CONTAINER

This application is a divisional application of U.S. application Ser. No. 07/829,027 filed May 28, 1991, now U.S. Pat. No. 5,365,980.

TECHNICAL FIELD

This invention relates to a container capable of use as a prefabricated, self-contained and self-supporting liquid products terminal transportable to remote locations for immediate use for storing and dispensing liquid products in large quantities ("bulk liquids"). In addition, the container can be combined with other containers to form a series of containers serving as a single large terminal facility. The container either can be active and dispense its liquid product by a pump, or it can be passive and dispense its liquid products by gravity or by attachment to an external pump, such as a portable pump or a connection in series to an active container. In addition, the container may also be used to easily convert all or part of a dry cargo vessel to a temporary or permanent liquid products carrier.

This invention also relates to methods of using a container to quickly and easily create a bulk liquid products storage and dispensing terminal facility for flammable, explosive, hazardous and non-hazardous liquid products, as well as certain flowable bulk dry products, even in remote and primitive locations lacking basic support services such as electricity. Such a facility would be capable of storing and dispensing such products immediately upon arrival.

This invention also relates to methods of using a container to quickly and easily convert all or part of a dry cargo vessel into a carrier for flammable, explosive, hazardous and non-hazardous liquid products.

This invention also relates to methods of using two or more containers to establish a loaded terminal facility at a location previously lacking available terminal facilities for bulk flammable, explosive, hazardous and non-hazardous liquid products and bulk flowable dry products.

BACKGROUND ART

Bulk liquids are traditionally transported in specialized tanker vessels. These ships are relatively few in number compared to dry cargo vessels and require specialized terminal facilities for discharging their cargo ashore for storage and further distribution. These bulk liquid terminals usually need a power source to pump the stored liquid out of the terminal.

Dry cargo vessels are generally configured to transport a plurality of containers of standardized sizes and shapes ("standardized cargo containers") which are described below.

The conversion of dry cargo vessels into liquid product carriers is desirable in order to increase the number of vessels able to carry bulk liquid products. Further, the use of multiple discrete liquid product containers to convert the dry cargo vessels is preferred in order to maximize the increased flexibility conversion offers in determining the portion of a vessel's dry cargo capacity to convert into liquid cargo capacity.

In addition, many commonly transported and stored liquid products require certain safety features on their containers. Petroleum products, for example, require that pressures within a container be maintained within a certain range in order to prevent an explosion or an implosion. Also, an inert gas blanket must fill the ullage of the container in order to prevent an explosive gas mixture from developing. Oxygen-containing gases, such as air, must be excluded from any place in which petroleum fumes might gather in a dangerous quantity, therefore, a proper venting system is required. Fire-fighting or fire-prevention systems also may be needed.

Many locations have the ability to make liquid products from local raw materials, but currently lack a terminal facility or tank farm to store the manufactured liquid products pending the arrival of an appropriate carrier. Therefore, these locations export raw solid materials instead of manufactured liquid products, to their economic detriment.

Currently, a liquid products terminal facility or tank farm able to receive off-loaded bulk liquid cargo or to store bulk liquid cargo pending the arrival of a liquid products carrier must be constructed using traditional means encompassing much expense, pre-planning and a lengthy period of time.

The inventor is not aware of any container that can be used to convert all or part of a dry products carrier into a liquid products carrier and that can also be used as a transportable, prefabricated bulk liquid products terminal capable of rapidly creating a storage and dispensing facility for bulk liquid products even in remote and primitive areas or to be easily loaded and unloaded aboard a dry cargo vessel.

U.S. Pat. No. 4,746,034 to Ata et al. discloses a portable liquid container which can be stacked up to three units high. When stacked, the containers can be connected in a manner permitting the upper tanks to drain into the lowest tank. Liquid is discharged solely by gravity through a valve located underneath the container which is connected by a pipe to a hole located in the lowest point of a floor which has four sloping triangular portions whose apices converge at the lowest point.

U.S. Pat. No. 4,782,973 to Wiese discloses a storage tank having a double-walled bottom which permits the insulation of the tank bottom, and a flanged discharge valve suitable for the double-walled bottom configuration for gravity discharge of the liquid.

U.S. Pat. No. 2,328,080 to Hansen discloses a stationary storage tank located inside a housing designed to reduce condensation and with a hood or cowl located over the tank to facilitate the exit of fumes from the housing and to prevent moisture, dirt and other undesirable elements from entering the housing.

U.S. Pat. No. 3,814,290 to Gerhard discloses the use of a trough in the interior of a tank to promote easy draining and cleaning of a liquid cargo tank that has a plurality of compartments.

The above containers are not specifically designed to serve as a dual purpose transportation container and terminal for storing and dispensing bulk liquid products, including flammable or other hazardous liquid products. None provide access for a person to enter the container, none has an active means of pumping the stored liquid out of the container, none has an active fire protection or control means attached, nor does any have a means for providing and maintaining an inert gas cover when necessary or required, or for venting the container other than directly into the atmosphere at the tank top.

U.S. Pat. No. 3,781,139 to Lohse discloses a detachable power unit comprising an internal combustion engine and an energy transducer for attachment to freight containers.

U.S. Pat. No. 3,386,605 to Lafont discloses a large plastic bag able to permit standard modular size demountable cargo containers to carry bulk liquid cargo instead of packaged cargo.

U.S. Pat. No. 4,143,588 to Exler discloses a ventilation system comprising walls and channels inside a "deepfreeze" container to maintain an even temperature and humidity throughout the interior of the container transporting standard dry cargo at a controlled temperature.

U.S. Pat. No. 2,954,003 to Farrell et al. discloses a liquid products tank capable of transporting liquified gas at low temperatures in the hold of a ship using cables, keys and keyways to secure the tank so that changes in the size of the tank due to temperature extremes will not affect the ability of the ship to transport the tank. The tank is suspended within a thermal barrier so that it may carry cryogenic cargo without significant warming and without harmful contact with the ship's structure.

U.S. Pat. No. 3,067,713 to Meesen discloses a freighter for low-temperature liquified gas comprising tanks of light alloy metal mounted in a series of corrugated and beveled guides within the insulated hold of a ship to allow movement of the tank in all directions due to changes in tank dimensions brought about by temperature extremes of the liquified gas cargo to be carried in the tanks.

U.S. Pat. No. 3,115,984 to Henry et al. also discloses a tanker for carrying low-temperature liquified gas comprising at least one multiple compartment tank in an insulated hold specially constructed for use aboard the tanker.

U.S. Pat. No. 4,107,803 to Sylverest discloses a self-contained and self-powered sea terminal which floats on the surface of the sea designed to store and discharge liquids through pumps located onboard the terminal.

None of these references discloses the degree of transportability and features necessary to allow a container for flammable, explosive, hazardous, or non-hazardous liquid products both to be carried aboard a dry cargo vessel thereby permitting its use as a liquid products carrier), and to be used as a prefabricated, transportable liquid products terminal facility for use in areas lacking needed terminal facilities. These features in a container allow the shipment of liquid products aboard a greater number of types of vessels and to a greater number of places.

It is therefore an object of this invention to provide a liquid products container that can be transported to a desired location lacking a liquid products terminal or tank farm (even to a remote location lacking an available electrical supply), and can serve as a prefabricated, self-contained terminal immediately able to store and dispense flammable, hazardous or explosive liquid cargo, as well as non-hazardous liquid cargo and some types of dry bulk cargo, such as cement.

It is a further object of this invention to provide a multiple-container liquid products terminal facility at a remote location without undue expense or unnecessary duplication of equipment by using a single active container in association with one or more passive containers, or by using one or more passive containers in association with some other external pump source or in a location and manner permitting gravity discharge of the containers' contents.

It is a still further object of this invention to provide a liquid products terminal having a loading arm ("rack") for rapid and easy transfer of liquid from the terminal to trucks or tank cars.

It is a still further object of this invention to provide a storage container for liquid products capable of dispensing its liquid product immediately upon its arrival and filling at a desired location, even in a remote area.

It is a still further object of this invention to provide a liquid products container that can carry many types of liquid cargo and be easily loaded onto and carried aboard a dry cargo vessel, thereby converting said vessel in whole or in part to a liquid products carrier and increasing the amount and type of transportation available to carry bulk liquid cargo.

It is a still further object of this invention to provide an economically efficient means for remote locations to store and dispense various amounts of bulk liquid cargo under necessary storage conditions pending the arrival of an appropriate carrier.

It is a still further object of this invention to provide a method for increasing the number of vessels able to serve as an appropriate carrier for bulk liquid products or bulk flowable dry products.

DISCLOSURE OF INVENTION

These and other objects are obtained by a liquid products container comprising, in its preferred configuration, a hollow body for liquid products having a size and shape able to fit directly, without modification, into the container cells of a containerized cargo vessel or into the hold of a bulk dry cargo vessel for easy and rapid transportation to a remote location. The container further preferably comprises a power source, a deepwell pump, a firefighting system, a venting system, a pressure-control system and an inert gas system. These features allow immediate use of the invention as an independent terminal for bulk petroleum products, other flammable, hazardous or explosive bulk liquid products, and non-hazardous bulk liquid produces or flowable dry bulk produces regardless of available shore facilities.

In its preferred configuration, this container has the footprint of a standard shipping container with two short side walls and two long side walls, but has the overall height of approximately five standard shipping containers stacked one on top of the other in their normal shipping mode. The storage tank and supporting structure are preferably four standard shipping containers high, and the top frame and associated devices are no more than an additional standard shipping container in height. The height may be varied in order to fit various dockside crane capabilities or vessel configurations without changing the basic function of the unit. The footprint may be varied to fit any other mode of transportation without changing the basic function of the unit.

The container preferably has two basic forms: passive and active. The passive container comprises standard container lifting attachments on its top and forklift channels at its bottom. It has devices for controlling the pressure inside the container, for providing and maintaining an inert gas cover in the ullage, and for preventing or fighting fires. Preferably, it has two fittings at its bottom (one each at the bottom center of each long side wall) for pipes or hoses for connection to one or two other containers, a pipeline, or a gravity dispensing outlet, or for connection to a dispensing valve. To reduce clingage and residual liquid product, the bottom floor is preferably slanted from each short side wall toward a flat section under the center fittings. The center fittings exit the container through recesses built into the long walls and do not protrude beyond the long walls.

The active container comprises, in addition to the above, a pump for pumping its cargo out and through a dispensing device such as a loading arm (or rack), and, preferably, a meter with a prover to measure the amount of cargo dispensed, and a power source for the pump, which may either be connected to a local power supply, such as steam or electricity, or to an internal combustion engine connected to the container itself.

In its preferred method of use, an empty unit is loaded into the hold of a dry cargo vessel. The unit is then attached to a common vent system that also serves any other similar units loaded into the same hold. One or more containers may then be filled with bulk liquid cargo (or flowable dry cargo), thereby converting the dry cargo carrier at least in part into a liquid products carrier. If the cargo is to be transported to a port lacking a liquid products storage and dispensing facility, at least one unit remains empty. The vessel then sails to a remote port lacking a liquid products storage and dispensing facility.

If the remote port has a liquid products storage and dispensing facility, the cargo can be off-loaded directly into such facility. However, if the port lacks such a facility, the empty unit is off-loaded first. A first full unit then discharges its cargo into the off-loaded empty unit. Once transfer of the liquid cargo into the off-loaded unit is completed, the now-empty first unit is off-loaded and filled with cargo from a second full unit still in the vessel's hold. This process continues until all desired units and cargo are off-loaded. This process results in a new storage and dispensing shore facility able to immediately dispense liquid (or flowable dry) products.

The same process can be used to move the terminal and cargo overland to a location remote from the shore by transporting one or more empty containers by truck, train or other transportation means from the port to the desired location where they are off-loaded, transferring the cargo of a filled first container by tank truck, tank cars, pipeline or other transportation means from the port to the new location, filling the empty container, transporting the now-empty first container by truck, train or other transportation means to said location, and filling it with cargo transported by tank truck, tank car, pipeline or other transportation means from a second full unit. Again, this process continues until all desired units and cargo are transported to the desired remote overland location.

Of course, trucks, trains or other transportation means configured for carrying standard containers can be used to transport filled and empty containers overland as well, with the same process as for dry cargo vessels being used for loading and unloading.

BEST MODE FOR CARRYING OUT THE INVENTION

Figure 1:
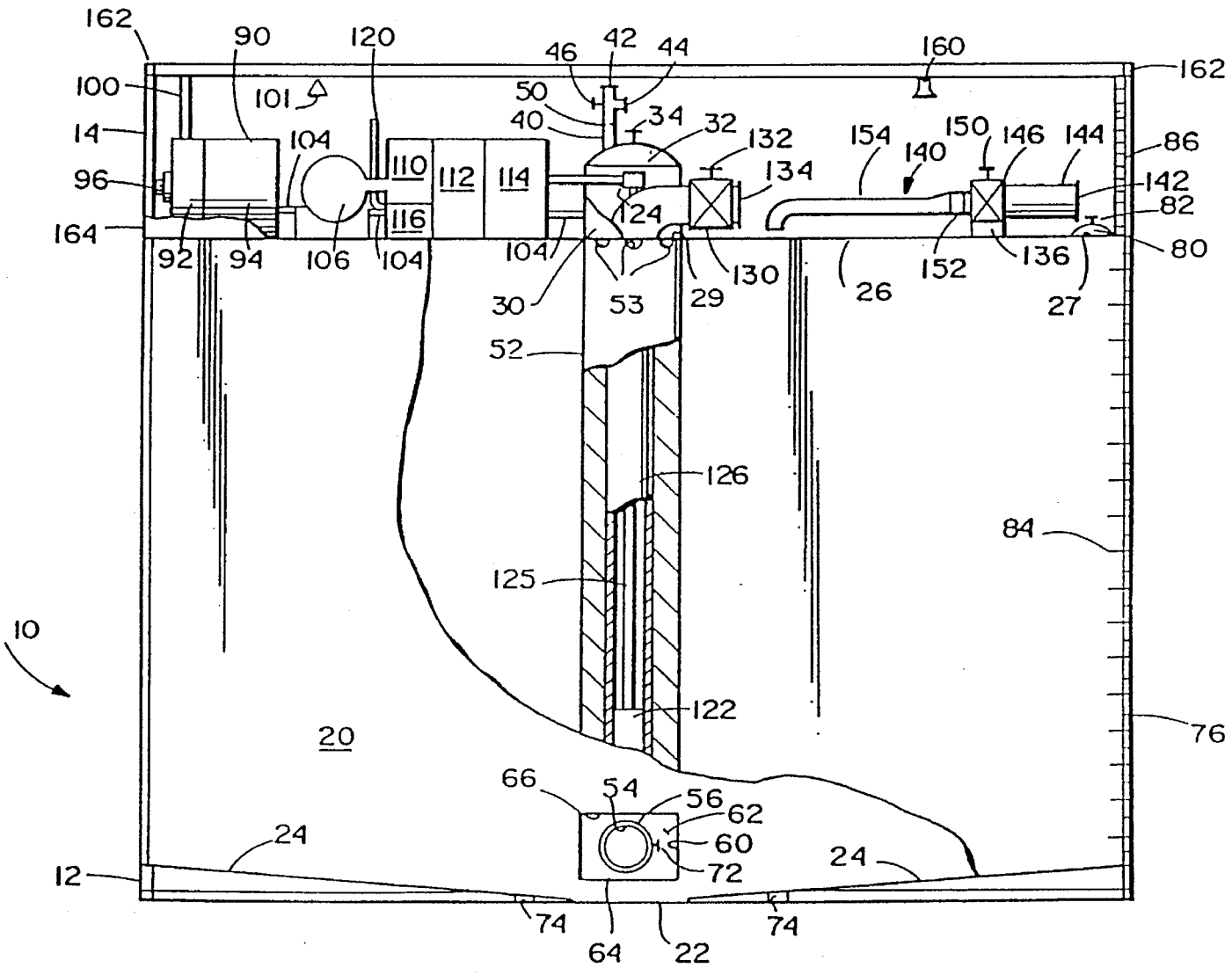
FIG. 1 is a partially cut away elevational view of the preferred embodiment of the invention.

Referring to FIG. 1, the preferred embodiment of the invention is shown. The container is comprised generally of a hollow body 10, supported by a flat supporting frame 12. A top frame 14 comprising multiple frame members is attached to the top of hollow body 10. While hollow body 10 and frame 12 may be of any size and shape, in the preferred embodiment hollow body 10 is a substantially rectangular parallelepiped except that it has sloping bottom surfaces as described below.

Currently, the shipping industry relies heavily upon containerized vessels capable of transporting standard shipping containers with standardized sizes and lifting sockets capable of transfer to semi-trailer trucks or railroad flatcars for land transportation. The current standardized width for most, if non all standard shipping containers is eight feet. There are four generally used standardized lengths of twenty, twenty-five, thirty-five and forty feet. The heights of standard shipping containers vary from generally eight feet to generally ten feet. Of course, in the future, standardized sizes may vary from the current sizes and this invention can easily be conformed to the new standardized sizes.

Preferably, hollow body 10 and supporting frame 12 are four standard shipping cargo containers (approximately forty feet) high. Top frame 14 is preferably approximately five to seven feet high. The container is thus preferably approximately forty-five to forty-seven feet high.

Figure 2:
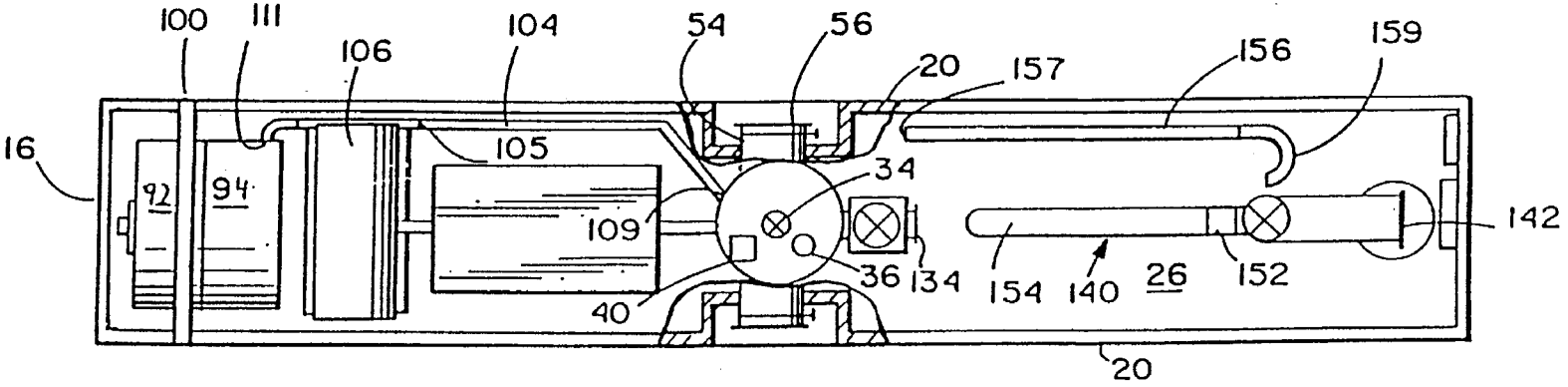
FIG. 2 is a top, partially cut-away plan view of the preferred embodiment of the invention in its active form.

As seen in FIG. 2, hollow body 10 has the width of a standard shipping container along short walls 16 and the length of a standard shipping container along long walls 20 in the preferred embodiment.

Referring again to FIG. 1, the floor of hollow body 10 is composed of three sections which may be integrally formed. Center section 22 is flat and centered between the two short walls 16, and extends from one long wall 20 to the other long wall 20. Each of the two sloping sections 24 is attached to a different short side wall 16, extends from one long wall 20 to the other long wall 20, and slopes downward to be connected to center section 22.

Ceiling 26 is connected to short walls 16 and long walls 20 at their tops and has circular hatchway 27 centered between the two long walls at one end and circular opening 29 centered between all four walls in the middle of ceiling 26.

Expansion dome 30 is attached to ceiling 26 surrounding opening 29. Hatch 32 is hingedly connected to the top of expansion dome 30 and can be opened or sealed by a locking mechanism attached to and engaged by wheel 34. Referring to FIG. 2, attached to hatch 32 is adaptor 36 which permits the attachment of gauging equipment to take soundings without breaching the inert gas cover that needs to cover certain types of potentially explosive cargos.

Referring again to FIG. 1, venting manifold 40 is also attached to hatch 32 and comprises venting standpipe port 42 to which is attached a venting standpipe when the container is in use on land, or in use aboard vessels under conditions requiring a standpipe extension. Venting manifold 40 also comprises common venting port 44 which is connected to a common venting system for atmospheric venting outside the hold when the container is in use aboard a vessel. Selector valve 46 is attached to venting manifold 40 between venting standpipe port 42 and common venting port 44 such that one port is open and the other is closed at any given time.

Pressure and vacuum venting valve 50 of any conventional design is attached to venting manifold 40 between its attachment to hatch 32 and selector valve 46. Valve 50 can be set to release gas or liquid at a given pressure, and to permit the introduction of atmospheric gas at a partial vacuum in order to prevent explosion or implosion, respectively.

Deep well shaft 52 is attached to ceiling 26 underneath expansion dome 30 around the perimeter of opening 29 and descends to be connected to center section 22. Deep well shaft 52 is provided with openings 53 at its top and bottom to permit the inflow of the liquid and gases contained inside hollow body 10 into deep well shaft 52.

Figure 3:
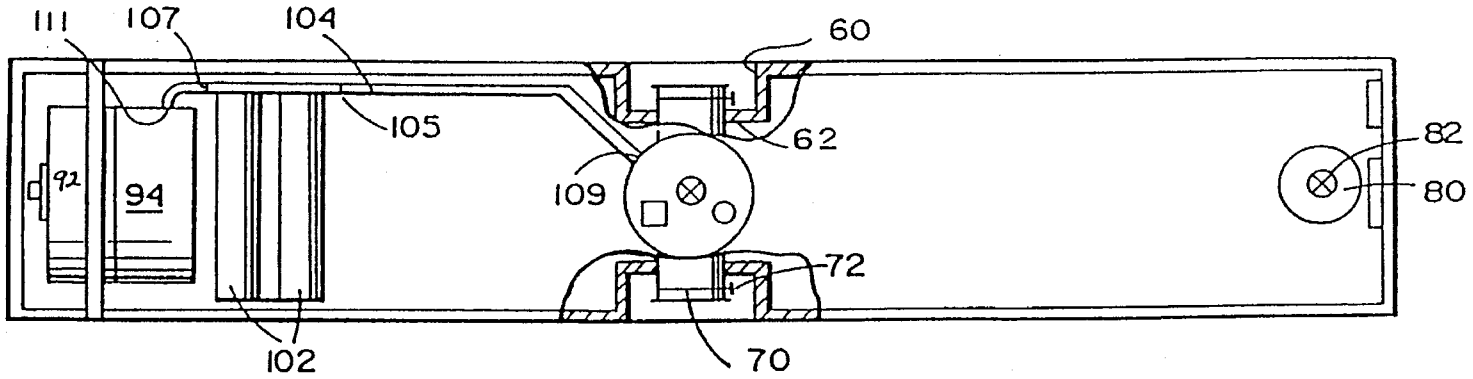
FIG. 3 is a top, partially cut-away plan view of an alternative embodiment of the invention in its passive form.

In the preferred embodiment, two pipes 54 are connected to either side of deep well shaft 52 at or near its connection with center section 22 perpendicular to each long wall 20. A flange 56 is connected to the end of each pipe 54 for connections to pipes or hoses which connect to other containers, storage tanks or discharge outlets, including gravity discharge outlets, or for connections to a discharge valve. As shown in FIGS. 2 and 3, the total length of each pipe 54 and flange 56 is determined to be such that flange 56 does not extend beyond the exterior edge of long wall 20.

As shown in FIGS. 1 and 3, an inset box comprising two side walls 60, back wall 62, bottom wall 64, and top wall 66 is built into each long wall 20 at or near the bottom of deep well shaft 52. Pipe 54 passes through a hole in back wall 62 in a sealed manner. Valve 70 is located between flange 56 and back wall 62 inside pipe 54, and is connected to and can be opened or closed by wheel 72. When not connected to a pipe or hose, pipe 54 may also be sealed with a plate releasably attached to flange 56.

Referring only to FIG. 1, built into supporting frame 12 are at least two channels 74 for receiving the prongs of a forklift.

Ladder 76 is attached to the exterior of a short wall 16 or long wall 20.

Hatchway 27 is covered by hatch 80 hingedly connected to ceiling 26 over hatchway 27. Hatch 80 can be opened or sealed by a locking mechanism attached to and engaged by wheel 82.

Ladder 84 is attached to the interior of the short wall 16 near hatchway 27 and extends from ceiling 26 to slanting section 24.

Ladder 86 is attached to top frame 14 if top frame 14 is taller than approximately six to seven feet.

A firefighting means, preferably foam generator 90 of any conventional design, is connected to the top of ceiling 26 at its end opposing hatchway 27 and comprises foam concentrate tank 92, water reservoir 94, and manual and/or automatic foam system activator 96. The foam is dispensed through piping system 100 which has dispensing nozzles 101 placed throughout top frame 14. The system is powered either by inert gas pressure or by a hookup to a water main.

Referring to FIG. 3, compressed inert gas cylinders 102 are releasably attached to inert gas manifold 104 which is connected to the top of ceiling 26. Inert gas manifold 104 has a discharge port 109 into the interior of hollow body 10, preferably at expansion dome 30 for the creation of an inert gas blanket in the ullage of the tank. The inert gas's release is regulated to occur at a given pressure inside the ullage by gas pressure regulator 105 located between cylinders 102 and discharge port 109.

There is also a discharge port 111 into the interior of water reservoir 94 for the creation of foam in case of need regulated by high-capacity regulator 107 located between cylinders 102 and discharge port 111.

Referring to FIG. 1, also in the preferred embodiment of the active container and attached to the top of ceiling 26 are an internal combustion engine 110, preferably diesel, whose exhaust is routed into heat exchanger and exhaust scrubber 106. Engine 110 powers a generator 112, which powers an electric motor 114. Also attached is a fuel tank 116 for engine 110 which has fittings 120 for connection to the vessel's venting system when the container is aboard a vessel.

Electric motor 114 also preferably is powerable by an external ship or shore electrical supply through connections and conduit of any conventional means and design.

On containers having internal combustion engine 110, the exhaust of engine 110 is routed into a heat exchanger and exhaust scrubber 106 which cools and scrubs the exhaust before discharging it into a port in inert gas manifold 104, in order to conserve the inert gas in cylinders 102 when the engine is in use.

Deep well cargo pump 122, of any conventional design, is located at the bottom of internal pipe 126 which is itself located inside deep well shaft 52. Pump 122 is powered by electric motor 114 through a right angle drive 124 of conventional design which extends from electric motor 114 into expansion dome 30 in a sealed manner. Drive 124 powers pump shaft 125 which descends into internal pipe 126 in a sealed manner and descends inside internal pipe 126 until it reaches and powers pump 122. Pump 122 pushes the liquid cargo up through internal pipe 126.

Internal pipe 126 makes a right angle bend in expansion dome 30 and passes through the side of expansion dome 30 in a sealed manner toward hatch 80 and terminates shortly after a valve 130 in a standardized flange 134. Valve 130 can be opened and closed by wheel 132.

In alternate embodiments, the pump may be powered by external steam, or by a hydraulic system of any conventional design-powered by engine 110 or by an external source.

Swivel 136 is attached to the top of ceiling 26 at a point between flange 134 and hatch 80. Loading arm 140, shown in its shipping position in FIG. 1, is movably attached to the top of swivel 136, and comprises a flange 142 connected to pipe 144 which, in turn, is connected to valve 146 which can be opened and closed by wheel 150. Meter 152 is attached to the opposite side of valve 146. Detachable loading pipe 154 is attached to the opposite side of meter 152.

Figure 4:
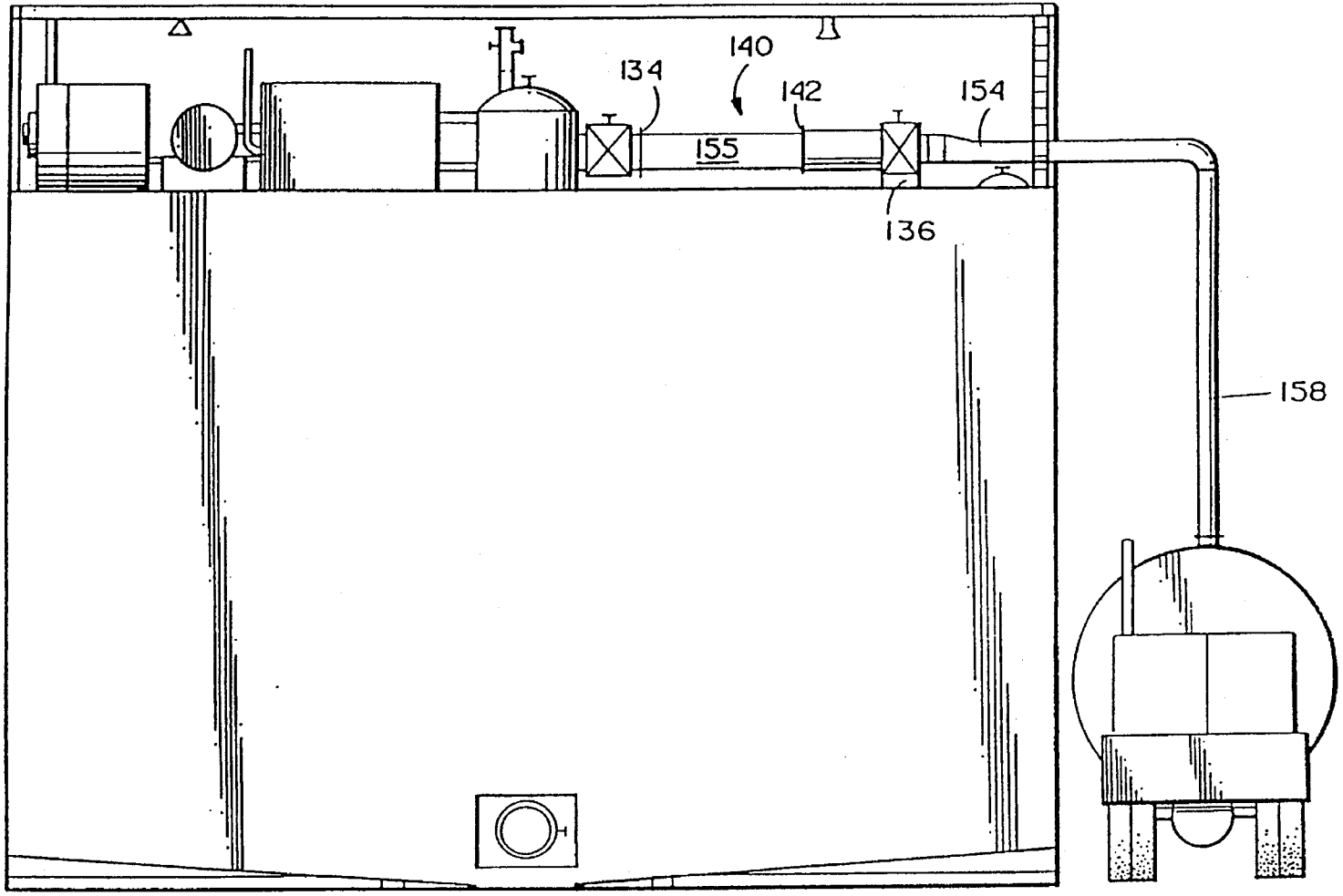
FIG. 4 is an elevational view of the preferred embodiment of the invention delivering liquid cargo to a truck parked alongside the invention.

As shown in FIG. 4, for the discharge of liquid detachable loading pipe 154 is removed and arm 140 is rotated on swivel 136 so that flange 142 faces flange 134 and pipe section 155 is connected to each flange. Standard cargo hose or jointed downspout 158 is then attached to the end of detachable loading pipe 154 for discharge of liquid into trucks or tank cars.

As shown in FIG. 2, prover 156, of conventional design, is also attached to the top of ceiling 26, and drains into the interior of hollow body 10 at port 157, and is connected by its U-shaped pipe 159 to loading arm 140 at meter 152 when detachable loading pipe 154 has been removed, loading arm 140 has been swiveled into its discharge position from its shipping position and pipe 155 has been connected to flange 144 and to flange 134. The accuracy of meter 152 is then verified. U-shaped section 159 is then detached from meter 154 and detachable loading pipe 154 is reattached, now extending out over short wall 16 in a position to load any vehicle parked beside said container through standard cargo hose or jointed downspout 158 as shown in FIG. 4.

Referring again to FIG. 1, a plurality of lights 160 can also be attached to top frame 14 and powered either by generator 112 or by an available external electrical source.

A plurality of lifting attachments 162 for hooks or other cargo lifting devices are also attached to top frame 14 for off-loading the container from ships or other transportation or for other manipulation. Preferably, these lifting attachments are standard container lifting sockets and are attached one per corner at the top of frame 14.

A spill containment edging 164 is connected to the top of ceiling 26 and runs around its perimeter in order to contain any liquid spilled onto the top ceiling 26. Preferably, the edging is approximately six inches high.

Stiffening frames can be added to provide support to the ceiling, the four side walls and the floor of hollow body 10. Such frames may be either internal or external depending upon the type of liquid to be contained in the hollow body 10. External frames will decrease the volume of hollow body 10 marginally, but will decrease clingage and increase ease of cleaning. The rungs of ladder 76 are not to extend beyond the external frames if external frames are used, or are to be recessed into short wall 16 or long wall 20 if internal frames are used.

As shown by FIG. 3, it is also apparent that the passive container will contain the same features as the active container except for pump 122 and its power source, engine 110, scrubber 106, fuel tank 116, vent connection 120, generator 112, motor 114, right angle drive 124, pump shaft 125, pipe 126, valve 130, wheel 132, flange 134, swivel 136, loading arm 140 and prover 156.

Figure 5:
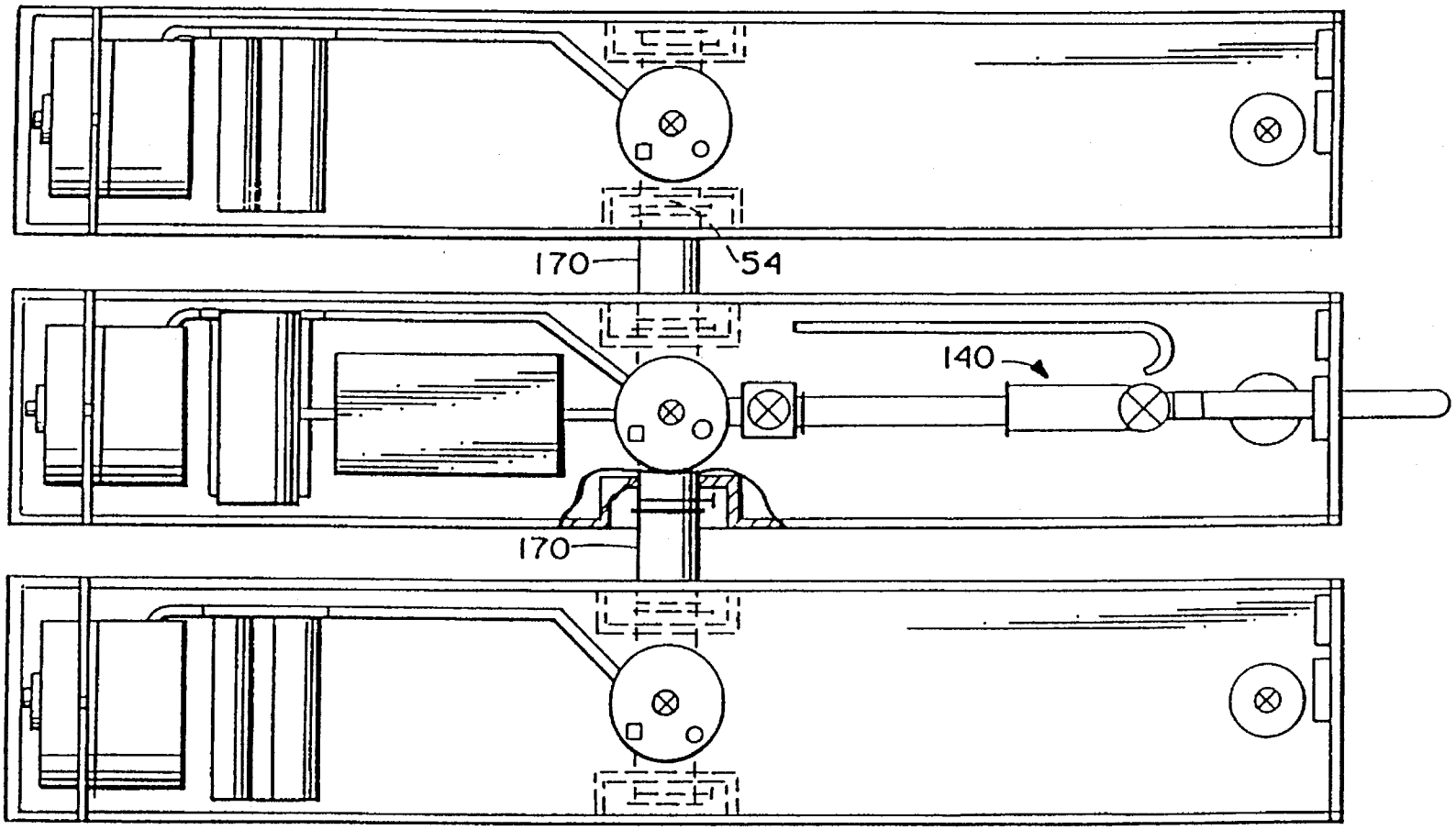
FIG. 5 is a top plan view of two passive alternative embodiments of the invention attached in series to an active preferred embodiment of the invention in the middle.

As shown by FIG. 5, one or more passive containers carrying the same cargo can be connected in series to an active container through pipes or hoses 170 attached to pipes 54 and the active container can then pump the cargo of the passive containers out through its loading arm 140.

This invention has been disclosed with respect to the certain particular preferred embodiments. It will be obvious to those skilled in the art that changes and modifications can be made in the disclosed embodiments without departing from the spirit and scope of the invention. For example, the height of the container can be varied in order to fit various dockside crane capabilities or vessel configurations without changing the basic function of the unit. Similarly, the footprint of the container may be varied to fit any other mode of transportation without changing the basic function of the unit. Also, although the general form of the preferred embodiment is a rectangular parallelepiped (except with sloping bottom surfaces), it is well known in the art that the container's edges can and should be rounded off in order to prevent "pocketing." Also, for example, opening 29 or hatchway 27 may have shapes other than circular without loss of function. In addition, when one or more passive containers are connected in series to one or more active containers, the method of circuiting the connections between the active and passive containers may be varied in order to provide isolation between a plurality of compatible cargoes or products. Accordingly, no limitations are to be implied or inferred except as specifically and explicitly set forth in the attached claims.

INDUSTRIAL APPLICABILITY

This invention provides bulk liquid containers that can be rapidly transported to a remote location lacking storage and dispensing facilities for bulk liquid products. The containers can be quickly deposited, and prepared to receive and dispense a wide variety of bulk liquid cargos including flammable, explosive, hazardous and non-hazardous liquid cargos as well as bulk flowable dry cargos, thereby serving as a prefabricated terminal. A loading rack allows for rapid and convenient filling of tank trucks or tank cars from the terminal. A container may be connected in series to other containers (with or without pumping means) to create a facility capable of storing and dispensing large amounts of bulk liquid products.

The containers can be loaded into dry cargo vessels thereby converting them in whole or in part into bulk liquid products carriers. Although some dry cargo vessels may not have sufficient capacity to be fully loaded with full liquid product containers, all should be able to be loaded with a plurality of full containers and at least one empty container.

When one or more loaded containers are carried in a vessel together with one or more empty or nearly empty containers, it is possible to transport the containers to a desired location and create a bulk liquid products terminal facility loaded with bulk liquid products ready for immediate dispensing by off-loading an empty container first, filling it with liquid cargo from a loaded container and then off-loading that container when it is empty and filling it, in turn, with liquid products from another full container, continuing in this manner until all desired containers and cargo are off-loaded, thereby immediately creating a loaded terminal facility.

Finally, of course, these containers may be transported to a desired location in an empty or nearly empty state and then deposited to immediately create a pre-constructed, self-supporting liquid products terminal facility or a tank farm to be filled from any source such as a tanker, a train, trucks, a pipeline, or an associated processing or producing facility.

The invention claimed is:

1. A method for transporting and off loading liquid cargo from a water borne vessel to an unloading location which may have no dockage facilities, the method comprising the steps of:

a) transporting a first substantially empty unstackable container on a water borne vessel to a desired location for off loading liquid cargo;

b) simultaneously transporting a second unstackable container at least partially filled with a liquid cargo on said vessel to said desired location for off loading; and c) unloading from said vessel and depositing at said desired off loading location said first substantially empty container, and off loading said liquid cargo from said second container on said vessel into said first container at said desired off loading location.

2. The method of claim 1 further including the step of: unloading said second container from said vessel and depositing said container at said desired off loading location.

3. The method of claim 2 further including the added steps of:

a) simultaneously transporting at least a third unstackable vessel at least partially filled with a liquid cargo; and b) off loading said liquid cargo from said at least partially filled third container on said vessel into said second and first container having been deposited at said desired off loading location.

4. The method of claim 1 wherein said transporting steps comprise transporting said unstackable container by a dry cargo water borne vessel.

5. The method of claim 4 wherein said transporting steps are performed by a standard containerized dry cargo water borne vessel.

6. The method of claim 5 wherein said unstackable containers are supported in the footprint of a standardized dry cargo container.

7. A method for transporting and off loading liquid cargo from a water borne vessel capable of transporting liquid cargo to an unloading location which may have no dockage facilities, the method comprising the steps of:

a) transporting a substantially empty unstackable container capable of containing and transporting liquid cargo on a water borne vessel capable of transporting liquid cargo to a desired location for off loading;

b) unloading from said vessel and depositing at said desired off loading location said substantially empty unstackable container; and c) off loading liquid cargo from said water borne vessel into said substantially empty container at said desired location for off loading.

8. The method of claim 7 further comprising the step of:

e) supporting said container on a vessel at a standardized footprint aboard a vessel; and f) wherein said unstackable container comprises:

A) a hollow body for containing a bulk liquid cargo having an upper portion and a lower portion and an opening in said upper portion and generally a rectangular parallelpiped shape with sloping bottom surfaces and the footprint of a standardized cargo container;

B) pressure control means connected to said hollow body for controlling pressure within said hollow body;

C) lifting means attached to said hollow body for receiving lifting devices; and D) unloading means including a pump connected to said hollow body for unloading liquid cargo from said hollow body.

9. The method of claim 8 wherein said container further comprises fire protection means for protecting said liquid cargo against fire connected to said hollow body and including the step of moving said container by lifting.

* * * * *